US005616055A

United States Patent [19]

Heeren

[11] Patent Number: 5,616,055

[45] Date of Patent: Apr. 1, 1997

[54] CONNECTING TERMINAL FOR A POLE SHAPED MEMBER

[75] Inventor: Johannes P. A. Heeren, Etten-Leur, Netherlands

[73] Assignee: White Products B.V., Oudenbosch, Netherlands

[21] Appl. No.: 262,079

[22] Filed: Jun. 17, 1994

[51] Int. Cl.[6] ..... H01R 4/28

[52] U.S. Cl. ..... 439/761

[58] Field of Search ..... 439/756–761

[56] References Cited

U.S. PATENT DOCUMENTS

| | | | |
|---|---|---|---|
| 1,596,891 | 8/1926 | Rensch . | |
| 2,204,387 | 6/1940 | Steenholdt | 439/761 |
| 2,872,460 | 3/1959 | Coleman | 439/761 |
| 5,088,941 | 2/1992 | Nölle | 439/762 |

FOREIGN PATENT DOCUMENTS

| | | | |
|---|---|---|---|
| 2184900 | 7/1987 | United Kingdom | 439/761 |

*Primary Examiner*—P. Austin Bradley
*Assistant Examiner*—Jill Demello

[57] ABSTRACT

A connecting terminal, e.g. for a battery pole, comprises an essentially cylindrical casing provided with a longitudinal division, with at least one pair of jaws separated by the longitudinal division, between which jaws is located an opening for acceptance of a bolt with an attendant contra-piece which has a curved surface which by exertion of pressure upon a corresponding curved surface of the jaws causes the jaws to close.

16 Claims, 1 Drawing Sheet

CONNECTING TERMINAL FOR A POLE SHAPED MEMBER

BACKGROUND OF THE INVENTION

The current invention pertains to a connecting terminal comprising an essentially cylindrical casing provided with a longitudinal division and having at least one pair of jaws separated by the division, between which jaws is located an opening for acceptance of a bolt having at an extremity an attendant contrapiece with a surface which by exertion of pressure upon a corresponding surface of the jaws causes the jaws to close.

Such a connecting terminal is known from DE-A-4011378, wherein the jaws of the connecting terminal are equipped with slanting surfaces and the attendant contrapiece is likewise equipped with corresponding slanting surfaces which operate together with these slanting surfaces. The disadvantage of the known connecting terminal is that the manufacture thereof is relatively complex as a result of the fact that the slanting surfaces must be applied in a special manner to the respective jaws and contrapiece, this being something which requires a special manufacturing step during fabrication of the known connecting terminal.

SUMMARY OF THE INVENTION

The aim of the current invention is to provide a connecting terminal which is more easily composed and fabricated from more commonplace and generally obtainable components.

To that end, the connecting terminal according to the invention is characterised in that both surfaces are curved.

The advantage of the connecting terminal according to the invention is that the closing of the co-operating corresponding curved surfaces requires less force, this being because the actual region of contact of the curved surfaces is only formed by two imaginary lines. The chance is therefore smaller that the mounting (in particular the tightening of the bolt, which can be done by, for example, a robot) will result in a rotation of the connecting terminal which is located on, for example, a battery pole. Extra measures required to hold the connecting terminal rigidly during the tightening of the bolt are therefore alleviated. Because the "contact surface" is only formed by two relatively thin lines, the tightening of the bolt shall require less energy, because the actual frictional surface of the area of contact between the two curved surfaces is minimal. Furthermore, it is of advantage that the required accuracy during the fabrication of the connecting terminal in accordance with the invention, in particular with respect to the preparation of the co-operating curved surfaces, is less than was previously required.

An embodiment of the connecting terminal in accordance with the invention is characterised in that the radius of curvature of both co-operating surfaces is the same.

Of advantage hereby is the fact that, in a closed state, both surfaces and therefore the jaws and the attendant contrapiece align to each other accurately, so that a very compact embodiment of the connecting terminal arises, which embodiment requires little physical space, in particular under the bonnet of a vehicle.

The sub-claims contain further possible embodiments of the connecting terminal in accordance with the invention, which further embodiments are extremely simple from the point of view of manufacture.

BRIEF DESCRIPTION OF THE DRAWINGS

The invention shall be further elucidated in the hereinafter on the basis of the accompanying drawing, within whose component figures components are depicted with the same reference numbers. Thereby.

DETAILED DESCRIPTION OF THE INVENTION

Figure 1:
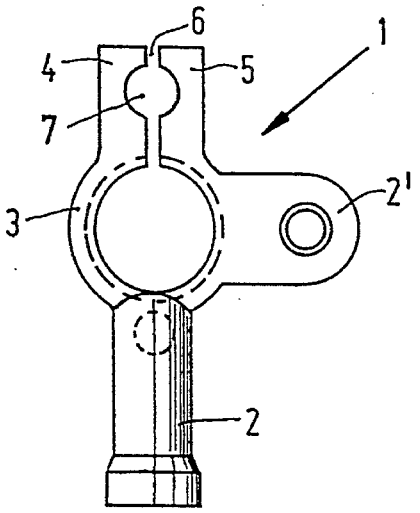
FIG. 1 depicts a plan view of a possible embodiment of the connecting terminal in accordance with the invention.
Figure 2:
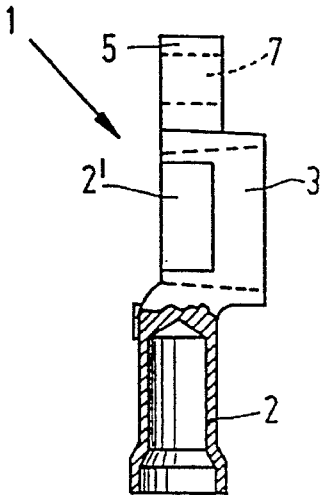
FIG. 2 depicts a right end view of the rendition in FIG. 1, in partial cross-section.
Figure 3:
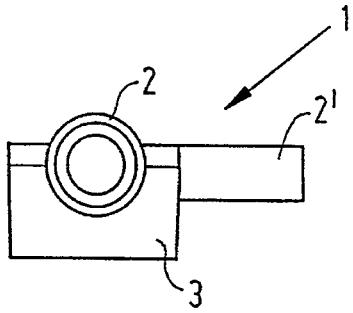
FIG. 3 shows a bottom view of the depiction of FIG. 1.
Figure 4:
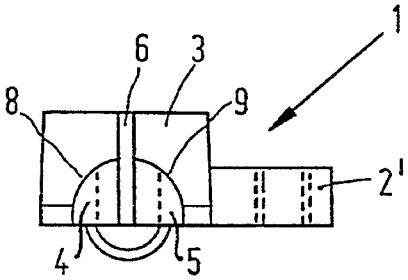
FIG. 4 shows a plan view of the depiction of FIG. 1.

FIGS. 1 to 5 inclusive show a possible embodiment of a connecting terminal 1, which connecting terminal 1 can be applied in clamping to a non-depicted battery pole. The depicted connecting terminal 1 contains a connecting portion 2 for the affixation of a non-depicted cable. Moreover, the depicted embodiment is equipped with an electrical connecting terminal 2'.

The connecting terminal 1 is comprised of a casing 3 which is essentially cylindrical and often somewhat tapered, which casing 3 can be pushed over a non-depicted pole, in which case jaws 4, 5 attached to the casing 3 move apart as a result of the presence of a longitudinal division 6. A longitudinally embodied opening 7 is formed in the plane of the longitudinal division 6. As is most evident from FIG. 4, the jaws 4 and 5 in this embodiment are provided with curved surfaces 8 and 9 at their undersides.

Figure 5:
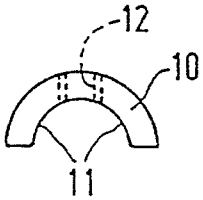
FIG. 5 depicts a contrapiece embodied as a plate portion for application in the subject of FIG. 1.

FIG. 5 depicts the plate portion 10 which, if desired, is provided with a screw thread which can be formed on the curved surfaces 8 and 9, whereby a non-depicted bolt which can be pushed into the opening 7 ensures that, upon tightening the bolt, the curved surfaces 8 and 9 of the jaws 4 and 5 co-operate with an internal surface 11 of the plate portion 10 in such a manner that the jaws 4 and 5 are consequently pushed toward one another.

The bolt to be inserted in the opening 7 can be tightened to the plate portion 10 by, for example, providing the bolt and an opening 12 in the plate portion 10 with a corresponding screw thread.

It goes without saying that the mechanical inversion of that which is here above elucidated is also applicable, in which case the plate portion 10 takes the place of the jaws 4, 5, and vice versa. If so desired, the electrical connecting terminal 2' can be omitted, in which case an electrical connection can be made on the previously cited non-depicted bolt in opening 7. It goes without saying that the connecting portion 2 can be embodied in plurality, in the sense that several electrical connections 2, 2' are present. Another obvious possibility is its placement at a different angle with respect to the casing 3.

Figure 6:
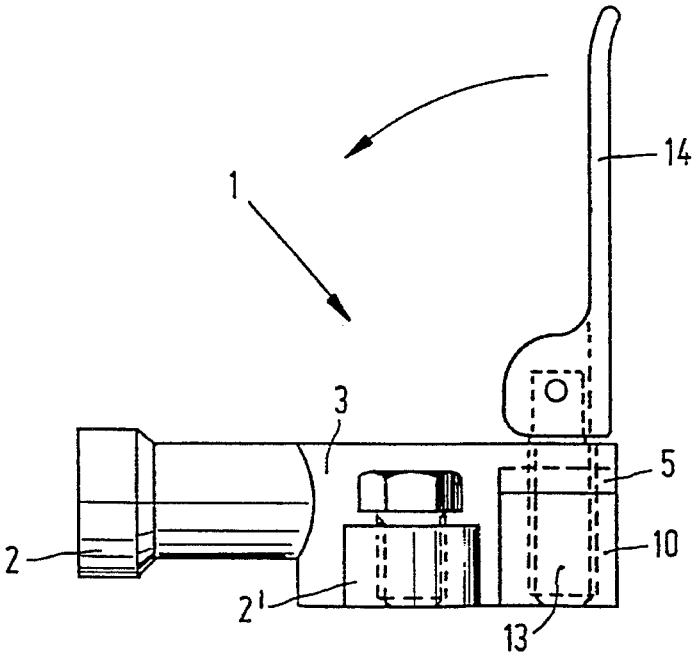
FIG. 6 shows a further embodiment of the connecting terminal according to the invention, which connecting terminal is equipped with a clamping bolt.

A particular embodiment of the connecting terminal 1 is rendered in FIG. 6, whereby one extremity of the herein depicted bolt 13 is connected by some means to the plate portion 10 (e.g. by means of a screw thread or of a non-depicted transverse pin through the bolt 13 and/or the plate portion 10), whereas a handle 14 which can be moved in the direction of the arrow is attached to the other extremity, which handle serves as a clamping device in the event that the handle 14 is moved about its hinge point through an angle of 90 degrees.

In the non-depicted lying position the handle 14 moreover protects the battery pole. A sufficiently wide handle 14 made from plastic then also isolates in principle the connecting terminal 1 and the battery pole electrically, so that the danger in principle of a possible short-circuit which could occur in a workshop if a metal object should fall on top of the battery is reduced. A further advantage is the especially simple detachability of the connecting terminal 1 from the battery pole.

In all cases, the connecting terminal 1 can be easily fabricated, because in particular the jaws 4, 5 can be formed by taking a rod and cutting it twice in a longitudinal direction and subsequently mounting the parts in question on the casing 3 after the jaws 4, 5 have been provided with a mutual opening 7. Plate portion 10 can be easily manufactured from a portion of a pipe which has been divided in a longitudinal direction.

I claim:

1. Connecting terminal comprising an essentially cylindrical casing provided with a longitudinal division and having at least one pair of jaws, each jaw having a camming surface, the camming surfaces being separated by the division, between which jaws is located an opening for acceptance of a bolt having, at an extremity, an attendant contrapiece with a corresponding camming surface which by exertion of pressure upon said camming surface of the jaws, causes the jaws to close, characterized in that both camming surfaces are camming continuously curved.

2. Connecting terminal according to claim 1, characterised in that the jaws collectively form half of a longitudinally divided portion of a cylindrical rod.

3. Connecting terminal according to claim 1, characterised in that each of the jaws is embodied so as to have a plate portion.

4. Connecting terminal according to claim 1, characterised in that the bolt is provided at its other extremity with a swingable clamping handle.

5. Connecting terminal according to claim 1, characterized in that the contrapiece is a plate portion.

6. Connecting terminal according to claim 5, characterised in that the plate portion is provided with a screw thread which corresponds to a screw thread on the bolt.

7. Cable provided with a connecting terminal according to claim 1.

8. Vehicle provided with a cable according to claim 7.

9. Connecting terminal comprising a casing provided with a longitudinal division and having at least one pair of jaws, each jaw having a surface, the surfaces being separated by the division, between which jaws is located an opening for acceptance of a bolt having, at an extremity, attendant contrapiece means with a corresponding surface which by exertion of pressure upon said surface of the jaws causes the jaws to close, characterized in that both surfaces are curved and further characterized in that the radius of curvature of both surfaces is the same.

10. Connecting terminal comprising a casing provided with a longitudinal division and having at least one pair of jaws, each jaw having a surface, the surfaces being separated by the division, between which jaws is located an opening for acceptance of a bolt having, at an extremity, attendant contrapiece means with a corresponding surface which by exertion of pressure upon said surface of the jaws causes the jaws to close, characterized in that both surfaces are curved and further characterized in that the attendant contrapiece forms half of a longitudinally divided portion of a cylindrical rod.

11. Connecting terminal according to claim 10, characterized in that the divided portion of the cylindrical rod is provided with a screw thread and the bolt has a screw thread which corresponds with the screw thread on the divided portion of the rod.

12. Connecting terminal comprising a casing provided with a longitudinal division and having at least one pair of separate jaws, each law having a camming surface, the camming surfaces being separated by the division, between which jaws is located an opening for acceptance of a bolt having, at an extremity, attendant contrapiece means with a corresponding camming surface which by exertion of pressure upon said camming surface of the jaws causes the jaws to close, characterized in that both camming surfaces are continously curved and further characterized in that the contrapiece means is defined by a plate portion and the camming surfaces of the jaws and the plate portion are complimentary in shape.

13. Connecting terminal comprising a casing provided with a longitudinal division and having at least one pair of separate jaws, each jaw having a surface, the surfaces being separated by the division, between which jaws is located an opening for acceptance of a bolt having, at an extremity, attendant contrapiece means with a corresponding surface which by exertion or pressure upon said surface of the jaws causes the jaws to close, characterized in that both surfaces are curved and further characterized in that the contrapiece means is a curved plate portion and the jaws collectively are a longitudinally divided half of a cylindrical rod.

14. Connecting terminal according to any one of claims 1, 9, 10, 12 and 13 in which contact of the surface of the jaws by the attendant contrapiece surface during exertion of said pressure is along a line on each jaw.

15. Connecting terminal comprising an essentially cylindrical casing provided with a longitudinal division and having at least one pair of jaws separated by the division, between which jaws is located an opening for acceptance of a bolt having, at an extremity, an attendant contrapiece with a surface which by exertion of pressure upon a corresponding surface of the jaws, causes the jaws to close, characterized in that both surfaces are curved, in that each of the jaws is embodied so as to have a plate portion; and in that the contrapiece forms half of a longitudinally divided portion of a cylindrical rod.

16. Connecting terminal comprising a casing provided with a longitudinal division and having at least one pair of jaws, each jaw having a surface, the surfaces being separated by the division, between which jaws is located an opening for acceptance of a bolt having, at an extremity, attendant contrapiece means with a corresponding surface which by exertion of pressure upon said surface of the jaws causes the jaws to close, characterized in that both surfaces are curved, and in that the contrapiece forms half of a longitudinally divided portion of a cylindrical rod.

* * * * *